US005403547A

United States Patent [19]

Smith et al.

[11] Patent Number: 5,403,547

[45] Date of Patent: Apr. 4, 1995

[54] OXIDATION RESISTANT LOW EXPANSION SUPERALLOYS

[75] Inventors: John S. Smith, Proctorville, Ohio; Darrell F. Smith, Jr.; Roneldo L. Fisher, both of Huntington, W. Va.; Karl A. Heck, Proctorville, Ohio

[73] Assignee: Inco Alloys International, Inc., Huntington, W. Va.

[21] Appl. No.: 227,296

[22] Filed: Apr. 13, 1994

Related U.S. Application Data

[63] Continuation of Ser. No. 104,394, Aug. 9, 1993, abandoned, which is a continuation of Ser. No. 613,081, Nov. 19, 1990, abandoned, which is a continuation-in-part of Ser. No. 452,284, Dec. 15, 1989, abandoned.

[51] Int. Cl.[6] ..... C22C 30/00

[52] U.S. Cl. ..... 420/581; 420/447; 420/448; 420/586

[58] Field of Search ..... 148/419; 420/442, 443, 420/445, 446, 447, 448, 582, 585, 581, 586

[56] References Cited

U.S. PATENT DOCUMENTS

| | | | |
|---|---|---|---|
| 4,066,447 | 1/1978 | Smith, Jr. et al. | 75/122 |
| 4,144,102 | 3/1979 | Smith, Jr. et al. | 148/2 |
| 4,642,145 | 2/1987 | Masumoto et al. | 148/336 |
| 4,853,298 | 8/1989 | Harner et al. | 428/630 |

FOREIGN PATENT DOCUMENTS

| | | |
|---|---|---|
| 147616 | 7/1985 | European Pat. Off. . |
| 433072 | 6/1991 | European Pat. Off. . |
| 2078602 | 11/1971 | France . |
| 2139424 | 1/1973 | France . |
| 2357652 | 2/1978 | France . |
| 2010329 | 6/1979 | United Kingdom . |

OTHER PUBLICATIONS

Taiwanese Alloy Publication, pp. 503–505, 524 & 525 Jul. 20, 1980.

Super Alloys, Special-Duty Materials, 1081 Metal Progress, vol. 122, No. 1, (1982), pp. 66–67.

Inone et al., "Microstructure and mechanical properties of rapidly quenched $L2_0$ and $L2_0+L1_2$ alloys in Ni-Al-Fe and Ni-Al-Co systems," Journal of Materials Science, 19, (1984) pp. 3097–3106.

Field et al., "Deformation of a Ni-Al-Fe Gamma/Beta Alloy," High Temperature Ordered Intermetallic Alloys III Symposium, (1988), pp. 567–572.

A. W. Cochardt, "High Damping Ferromagnetic Alloys",—Oct. 1956, Journal of Metals, pp. 1295–1298.

H. Masumoto, "On the Thermal Expansion of Alloys of Cobalt, Iron and Chromium, and a New Alloy 'Stainless-Invar'" Science Reports, Tohoku Imperial University, 23, 1934, pp. 265–280.

H. Masumoto, "On the Thermal Expansion of the Alloys of Iron, Nickel, and Cobalt, and the Cause of the Small Expansibility of Alloys of the Invar Type" Science Reports, Tohoku Imperial University, 20, 1931, pp. 101–123.

H. Masumoto, "On the Intensity of Magnetization in Iron-Nickel-Cobalt Alloys", Science Reports, Tohoku Imperial University, 18, 1929, pp. 195–229.

H. Masumoto, "On the Coefficient of Thermal Expansion in Nickel-Cobalt and Iron-Cobalt Alloys, and the Magnetostriction of Iron-Nickel Alloys" Science Reports, Tohoku Imperial University, 16, 1927, pp. 333–341.

H. Masumoto, "On a New Transformation of Cobalt and the Equilibrium Diagrams of Nickel-Cobalt and Iron Cobalt" Science Reports, Tohoku Imperial University, 15, 1926, pp. 449–477.

*Primary Examiner*—Deborah Yee

*Attorney, Agent, or Firm*—Blake T. Biederman; Edward A. Steen

[57] ABSTRACT

An oxidation resistant alloy containing iron, cobalt, nickel and at least 4 to 5% by weight aluminum having at least a duplex crystalline structure. One crystalline component of this structure is a gamma (fcc) phase having a gamma prime phase dispersed therein. The second crystalline component is enriched in aluminum compared to the first crystalline component and exhibits characteristics under X-ray diffraction and electron diffraction analysis of a BCC B2 structured phase.

28 Claims, 5 Drawing Sheets

OXIDATION RESISTANT LOW EXPANSION SUPERALLOYS

This is a continuation of application U.S. Ser. No. 08/104,394, filed on Aug. 9, 1993, now abandoned. U.S. Ser. No. 08/104,394, is a continuation of application U.S. Ser. No. 07/613,081, filed Nov. 19, 1990, now abandoned. U.S. Ser. No. 07/613,081 is a continuation in part of application U.S. Ser. No. 07/452,284, filed Dec. 15, 1989, now abandoned.

The present invention is concerned with oxidation resistant, ductile, high strength, superalloys and more particularly with low-expansion oxidation-resistant superalloys containing nickel and iron with cobalt.

THE PRIOR ART

Current state of the art, chromium-free, low expansion superalloys such as those described and claimed in U.S. Pat. Nos. 3,157,495, 4,200,459, 4,487,743 and 4,685,978 generally do not have adequate oxidation and overall corrosion resistance at high temperatures. Ni-Fe and Ni-Fe-Co low expansion superalloys not only have poor oxidation resistance, but they also suffer from the phenomenon known as stress accelerated grain boundary oxygen embrittlement sometimes referred to as dynamic oxygen embrittlement, or simply dynamic embrittlement. Current state of the art chromium-free low thermal expansion superalloys generally lack desired high strength above about 600° C. Additionally, as a general rule, the current state of the art low thermal expansion alloys grain coarsen rapidly at temperatures of about 1040° C. which are desirably used for brazing of components made of the alloys.

It is well known that chromium additions to these alloys can impart both oxidation and general corrosion resistance, and minimize grain boundary embrittlement. However, in nickel-, iron- and cobalt-based alloys, chromium also suppresses ferromagnetism, reduces the Curie temperature (the magnetic—nonmagnetic transformation temperature) and consequently increases the material's thermal expansion. When chromium is added in sufficient quantities to provide for general oxidation resistance, the material no longer has low thermal expansivity.

It is also well known that sufficient aluminum additions to nickel- and iron-based alloys can impart general oxidation resistance and increase strength. However, the state of the art low expansion superalloy technology teaches that aluminum additions increase the tendency for stress accelerated grain boundary oxygen embrittlement. Thus, U.S. Pat. Nos. 4,685,978, 4,487,743 and 4,200,459 all teach that aluminum must be as low as commercially possible to reduce the tendency for stress accelerated grain boundary oxygen embrittlement to occur. Commercial state of the art low expansion superalloys contain aluminum only as an unwanted impurity.

When aluminum is present in very high quantities in the intermetallic compound $Ni_3Al$, the trend is for even more drastically increased dynamic oxygen embrittlement over that of the low expansion superalloys. This occurs despite the exceptionally good general oxidation resistance of aluminum bearing intermetallic compounds. In addition, it is known that below about 600° C. the intermetallic NiAl is inherently brittle. Therefore, the current state of technology teaches that increasing aluminum content in nickel-base and nickel-containing alloys will either worsen the dynamic oxygen embrittlement or worsen lower temperature embrittlement, especially in low chromium or chromium-free versions of these alloys.

Outside of the realm of alloys known to possess a low coefficient of thermal expansion, applicants are aware of the teachings of U.S. Pat. No. 4,642,145 ('145 patent) which discloses nickel-iron-aluminum alloys and nickel-cobalt-aluminum alloys containing at least 8 atomic percent aluminum and having a B-2 type intermetallic compound present in the alloys. These alloys were produced in a fashion so as to impart a a microcrystalline structure with the crystal particles having a diameter in the range of 0.5 to 10 micrometers and, by definition in the patent, are required to have such a microfine crystalline structure. The microfine crystalline alloy examples of the '145 patent contain either cobalt or iron but not both elements together. Insofar as applicants are aware, the microfine crystalline structure required in the disclosure of the '145 patent is indicative of relatively poor mechanical characteristics at temperatures in excess of about 600° C. The '145 patent does not disclose any specific characteristics of the claimed alloys at elevated temperatures and is totally silent regarding stress accelerated grain boundary oxygen embrittlement. As a supplement to the '145 patent, Inone et al authored a technical paper entitled "Microstructure and Mechanical Properties of Rapidly Quenched $L2_0$ and $L2_0+L1_2$ Alloys in Ni-Al-Fe and Ni-Al-Co Systems" which was published in Journal of Materials Science 19(1984)3097–3106. In this paper, the authors reported much of what was disclosed in the '145 patent and concluded that wires produced by the melt quenching technique in Ni-Al-Fe and Ni-Al-Co systems were ductile even though "the usually solidified $\alpha'0$ and $\gamma'+\beta'$ compounds are extremely brittle."

Applicants are also aware of the teachings of Field et al in the technical paper entitled "Deformation of a Ni-Al-Fe Gamma/Beta Alloy" published as part of High Temperature Ordered Intermetallic Alloys III Symposium held November 29 to Dec. 1, 1988 at Boston, Mass. In this paper, Field et al tested a Ni-Al-Fe alloy identical in composition to the composition of Run 14, Example 11 of the '145 patent. This composition was melt spun and then annealed for two hours at 1100° C. to produce an essentially equiaxed microstructure with grains about 5 micrometers in diameter. After this treatment the microstructure was said to consist of B2 NiAl and gamma (fcc) components with an ordered gamma prime phase found within the gamma grains. As in the '145 patent, this technical paper does not disclose any characteristics of the alloy at elevated temperatures or any data relevant to stress accelerated grain boundary oxidation embrittlement.

OBJECT OF THE INVENTION

It is an object of the present invention to provide a novel alloy composition which will alleviate many, if not all, of the deficiencies of the current state of the art alloys as described hereinbefore and provide a novel alloy with good general oxidation resistance, dynamic grain boundary oxidation resistance, room temperature ductility, strength at temperatures above 600° C. together with a relatively low coefficient of thermal expansion (CTE).

DRAWINGS

Features of the present invention are illustrated in the drawings in which.

DESCRIPTION OF THE INVENTION

Figure 1:
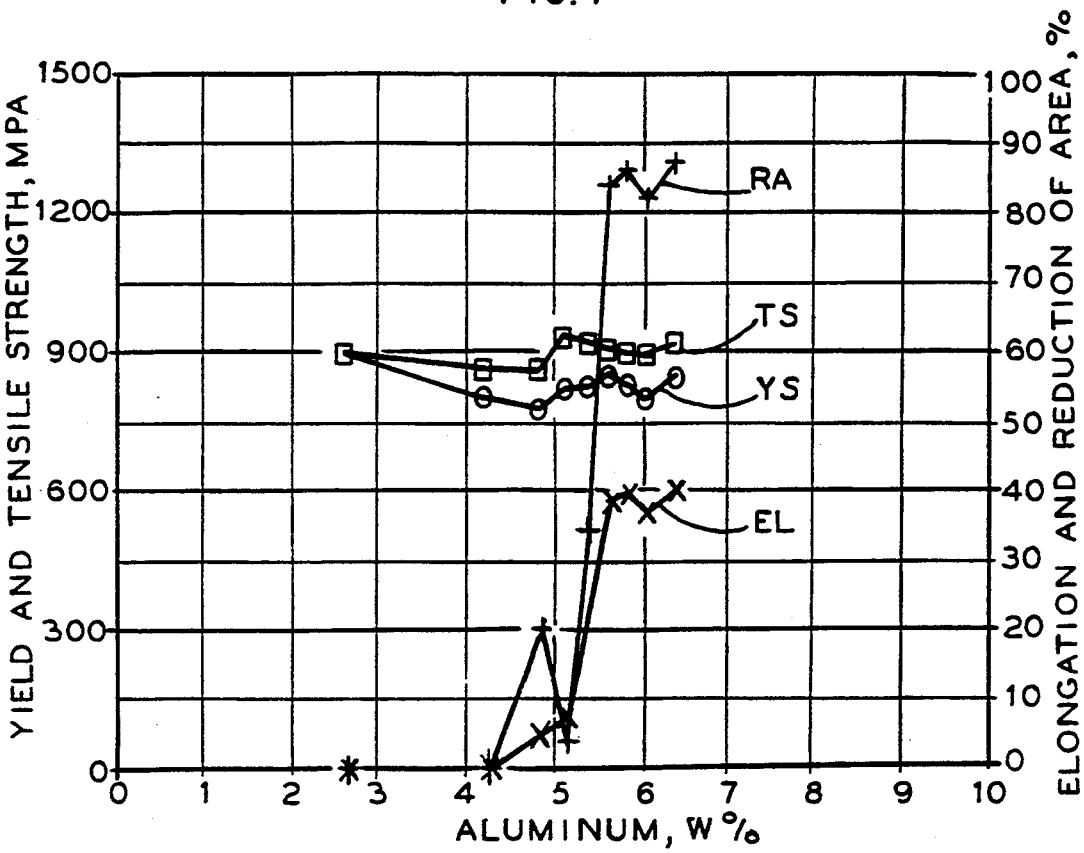
FIG. 1 is a graph interrelating mechanical characteristics of alloys at 760° C. with aluminum content.

The present invention specifically contemplates a duplex, oxidation resistant alloy comprising, in percent by weight, about 36 to 44% nickel, about 16 to 24% cobalt, about 5.5 to 6.5% aluminum, about 1.2 to about 1.8% titanium, up to about 0.1% carbon, up to about 0.5% total manganese, copper and chromium, up to about 0.3% silicon, up to about 2% molybdenum, up to about 2% tungsten, about 3 to about 4% niobium, about 0.002 to 0.01% boron with the balance being essentially iron in an amount of about 20 to 38% provided that when iron is less than about 24%, cobalt is at least 24%.

In order to alleviate some problems found to exist with alloys within the composition range set forth in the preceding paragraph, a duplex, oxidation resistant alloy is contemplated comprising in percent by weight, about 25 to about 40 or 45% nickel, about 25 to 38% cobalt, about 4.8 to about 6% aluminum, up to about 1.6% titanium, up to about 0.1% carbon, up to about 0.5% total manganese and copper, up to about 6% total chromium plus molybdenum, up to about 6% tungsten, about 0.5 to 6% niobium, about 0.002 to 0.01% boron with the balance being essentially iron in an amount of about 15 to 35%.

In a broader sense the present invention contemplates duplex alloys having:

1) as a first component a matrix comprising nickel, iron and cobalt in which the nickel, iron and cobalt are present in relative amounts necessary to provide the alloy with a CTE of less than about $13\times10^{-6}$ per ° C. at about 427° C. This matrix is transformed at or around an inflection temperature from a paramagnetic gamma phase existing above the inflection temperature to a ferromagnetic gamma phase existing below the inflection temperature.

2) a gamma prime phase (ideally $Ni_3Al$) within said matrix of the first component, and 3) a second, independent component in intimate association with the first component. This independent component contains nickel and aluminum and is believed to comprise ideally a body-centered cubic structure based upon NiAl or FeAl modified by cobalt, titanium or other constituents of the alloy. For purposes of this specification and claims the expression "in intimate association with the first component" means that microscopic examination of crystals or masses of the independent component shows, after annealing, a substantially complete wetting of the independent component by the first component. Electron microscopic examination of alloys which have been cooled after annealing shows a precipitated phase, gamma prime, which exists in the first (gamma) component be evenly distributed throughout the grain even near the grain boundaries with the independent component.

Broadly, the alloy can contain in percent by weight about 25–70% nickel, about 5% to 45 or 50% cobalt, about 45 to 75% nickel plus cobalt, 4 or 5 to 15% aluminum, 0 to 3% titanium, 0–10% e.g., 1–10% niobium or tantalum, 0–10% each of molybdenum and tungsten, 0–3% vanadium, 0–2% silicon, 0–1% manganese, 0–1% copper, 0–6% chromium, 0–2% hafnium or rhenium, 0–0.3% boron, 0–0.3% zirconium, 0–0.1% magnesium, calcium, yttrium and rare earths, 0–0.5% nitrogen, 0–0.3% carbon together with deoxidants, grain refiners, dispersoids and the like common to the method of manufacture of the alloy with the balance of the alloy being iron in the range of about 15 to 55% provided that when iron is less than about 24%, cobalt is at least 24%. Sulfur, phosphorus and oxygen (except where present as a dispersoid oxide) should be limited to a maximum of about 0.02% each. Occasionally, due to the high aluminum and other active metal content of the alloy, the oxygen content can be as high as 0.3%. By correlating the amounts of nickel, cobalt, and iron in the alloys of the present invention one can provide the alloy with a relatively low CTE measured at 427° C. e.g., in the range of about 10.6 to about $13\times10^{-6}$ per ° C. The coefficient of expansion is primarily controlled by the Ni-Co-Fe ratios, and secondly by the Al, Ti and Nb contents.

Advantageously, the board composition may be modified by providing cobalt of at least about 24% when iron is less than about 24%. Alternatively, niobium is advantageously at least 2.5%. Most advantageously, niobium is at least about 2.5% and titanium is less than about 0.8%. Advantageously, aluminum is present in an amount from about 4.8 to 6%. Furthermore, iron is advantageously less than about 30%. Molybdenum plus tungsten is advantageously limited to about 0 to 5%. Advantageously, cobalt is about 25 to 40% or iron is advantageously about 20 to 27.5%. Advantageously, the alloy may contain 0 to about 2% vanadium, about 2 to 6% chromium or about 2 to 6% molybdenum. Most advantageously, the alloy contains about 4 to 10% chromium plus molybdenum. Advantageously, nitrogen is limited to about 0.3%. The alloy may optionally contain about 0.2 to 2% yttria or complex oxide of yttria.

Alternatively, the alloy of the invention may contain about 25 to 45% nickel, about 25 to 35% cobalt, about 20 to 27% iron, about 4.8 to 5.8% aluminum, about 0 to 1.8% titanium, 0 to about 0.1% carbon, 0 to about 0.3% silicon, about 0.5 to 4% niobium, the sum of copper plus manganese being 0 to about 0.5% and the sum of molybdenum plus tungsten being 0 to about 5%. Furthermore, the alloy of the invention may alternatively contain about 25 to 40% nickel, about 25 to 35% cobalt, about 27.5 to 35% iron; about 4.8 to 5.8% aluminum, about 0 to 0.8% titanium; 0 to about 0.4% manganese, 0 to about 0.75% silicon, 0 to about 2% molybdenum; 0 to about 2% niobium and 0.001 to 0.01% boron.

Alternatively, for oxidation resistant alloys having a relatively low coefficient of thermal expansion, characterized by resistance to oxygen embrittlement and further characterized by notch ductility at about 650° C. in the annealed and aged condition, the alloy consists essentially of about 25 to 50% nickel, about 5 to 50% cobalt, about 45 to 75% nickel plus cobalt, about 4 to 10% aluminum, about 0 to 2% 0.2% titanium, 0 to about 0.2% carbon, 0 to about 6% chromium; 0 to about 2% total manganese, silicon and copper, 0 to about 0.5% silicon, 0 to about 0 to about 6% niobium, 0 to about 0.1% zirconium, 0 to about 0.02% boron, balance essentially iron in the range of 20% to 50% along with incidental impurities. Advantageously, the alloy contains at least about 2% niobium, 30 to 45% nickel or 4.8 to 6% aluminum.

In order to maintain the duplex (or even more complex) nature of the alloy of the present invention, it is advantageous to modify the aforestated broad range of composition such that when the sum of nickel plus cobalt is high, i.e. about 75% nickel plus cobalt the aluminum content of the alloy is in a very narrow range of about 8.0%. As the nickel plus cobalt content of the alloy decreases to roughly 67%, the permissible aluminum content broadens to about 7 to 15%. As the nickel plus cobalt content decreases further the permissible range of aluminum narrows to about 6 to 8% at 50% nickel plus cobalt and to about 5.0% at 45% nickel plus cobalt. These advantageous interrelations of nickel plus cobalt presume that nickel plus cobalt acts similarly to nickel and that nickel plus cobalt versus aluminum contains no elements of the group niobium, tantalum and titanium, which can, in limited amounts add to the effect of aluminum. Accordingly, in niobium-titanium and tantalum-containing alloys of the invention, the interrelations between nickel plus cobalt and aluminum set forth herein may be modified by a summation of the effect of aluminum, niobium, titanium and tantalum rather than by aluminum per se.

Those skilled in the art will appreciate that the iron, nickel, cobalt and aluminum contents of the alloys of the present invention determine the basic character of any particular alloy and that Ti, Nb, Mo, W, Ta, etc. generally increase the hardness and strength of the alloy adding to the effect of aluminum. Surprisingly, it has been observed that cobalt enhances castability and workability compared to similar alloys devoid of or very low in cobalt. In addition, alloys of the invention which contain iron, nickel and cobalt have enhanced high temperature properties, notch strength and resistance to hydrogen embrittlement.

CTEs of alloys of the present invention have been determined on alloys containing about 2 to 3% niobium and about 1.3 to 2% titanium. If molybdenum is present in the alloy of the present invention in an amount, for example, about 5% along with niobium and titanium as previously specified, the coefficient of thermal expansion measured at 427° C. can be as high as $12.9\times10^{-6}$ per ° C. The elements niobium (with associated tantalum), molybdenum and titanium contribute to the strength of the alloys, particularly the rupture strength and resistance to creep at elevated temperatures, e.g., in excess of about 600° C. It is highly advantageous for the alloys of the invention to contain about 0.5 to 5% niobium in as much as niobium appears to enhance both strength and ductility of the alloys at elevated temperatures, e.g., 600°–800° C. In addition, in alloys containing about 30% iron the presence of niobium in an alloy low in titanium appears to inhibit the development of room temperature brittleness after alloy exposure to temperatures of about 600° C. for extended periods of time. It has been observed that in alloys containing between 5 and 6.5% of aluminum, niobium appears to enhance agglomeration and spheroidization of the second microstructural component of the alloys, i.e., the second microstructural component appears globular. Tantalum is expected to act, on an atomic basis, in alloys of the invention in the same manner as niobium and may be used as a substitute for niobium.

One additional advantage of the alloys of the present invention is a relatively low density compared to low expansion, high temperature alloys of the prior art.

In formulating alloys of the present invention it is to be observed that each and every percentage of alloying ingredients as set forth in Table I can be used in combination with any other percentage of alloying ingredient as long as the contents of nickel, cobalt and iron are balanced to provide a low coefficient of thermal expansion as taught in the art and the contents of nickel and cobalt versus aluminum, etc. are interrelated set forth hereinbefore. Furthermore, Table I along with the aforestated composition range teaches that for each element, the present invention contemplates not only the aforestated range of composition, but also any range definable between any two specified values of weight percent of a specific element.

TABLE I

| Alloying Element | Percent by Weight | | | | |
|---|---|---|---|---|---|
| Nickel | 30 | 40 | 50 | 60 | 70 |
| Cobalt | 5 | 15 | 25 | 35 | 40 |
| Aluminum | 4 | 5 | 6 | 7 | 15 |
| Titanium | 0 | 0.2 | 1 | 1.5 | 3.0 |
| Carbon | 0.01 | 0.03 | 0.1 | 0.2 | 0.3 |
| Copper | 0 | 0.25 | 0.50 | 0.75 | 1.0 |
| Chromium | 0 | 1.0 | 2.0 | 4.0 | 6.0 |
| Manganese | 0 | 0.25 | 0.5 | 0.75 | 1.0 |
| Silicon | 0 | 0.5 | 0.75 | 1.0 | 2.0 |
| Molybdenum | 0 | 3 | 5 | 8 | 10 |
| Tungsten | 0 | 3 | 5 | 8 | 10 |
| Niobium (& Tantalum) | 0 | 1 | 3 | 5 | 6 |
| Boron | 0 | 0.005 | 0.1 | 0.2 | 0.3 |
| Vanadium | 0 | 0.75 | 1.5 | 2 | 3.0 |
| Hafnium | 0 | 0.5 | 1 | 1.5 | 2 |
| Rhenium | 0 | 0.5 | 1 | 1.5 | 2 |
| Zirconium | 0 | 0.1 | 0.15 | 0.25 | 0.3 |
| Nitrogen | 0 | 0.1 | 0.2 | 0.3 | 0.5 |
| Oxidic Dispersoid | 0 | 0.2 | 1 | 1.5 | 2 |
| Iron* | 15–55 | 15–55 | 15–55 | 15–55 | 15–55 |

*There is a proviso that when iron is less than about 24%, cobalt is at least 24%.

Although the multiplicity of specific ranges of individual elements as indicated in Table I are operable in accordance with the present invention it has been found advantageous to employ alloy ranges as set forth in Table II.

TABLE II

| Element | % by Weight | | | | |
|---|---|---|---|---|---|
| | Range A | Range B | Range C | Range D | Range E |
| Ni | 41–44 | 35–50 | 36–44 | 25–45 | 25–40 |
| Co | 16–19 | 5–25 | 16–24 | 25–35 | 25–35 |
| Al | 5–6.5 | 5–10 | 5.5–6.5 | 4.8–5.8 | 4.8–5.8 |
| Ti | 0.5–1 | 1–2 | 1.2–1.8 | 0–1.8 | 0–0.8 |
| C | 0–0.05 | 0.2 | 0–0.1 | 0–0.1 | 0–0.05 |
| Mn | 0–0.5 | * | *** | 0–0.5 | 0–0.5 |
| Si | 0–0.75 | * | 0–0.3 | 0–0.3 | 0–0.3 |
| Mo | 0–2 | ** | **** | — | ***** |

TABLE II-continued

| Element | % by Weight | | | | |
|---|---|---|---|---|---|
| | Range A | Range B | Range C | Range D | Range E |
| W | — | ** | **** | — | — |
| Nb | 0–2 | 2–5 | 2.5–4 | 0.5–4 | 0.5–4 |
| Zr | — | 0–0.1 | — | — | — |
| B | 0.001–0.01 | 0–0.02 | 0.002–0.01 | 0.002–0.01 | 0.001–0.02 |
| Fe | Bal. 25 | Bal. 24–50 | Bal. 24–38 | 20 –27.5 | 27.5–35 |

*Si 0–0.5 and Mn + Si + Cu + Cr ≦ 2%
**Up to 5% each Mo and W but Mo + W ≦ 5%
***Cu + Cr + Mn ≦ 0.5%
****Mo + W ≦ 2
*****Cr + Mo = 0–10% Total The alloys of Range A in Table II have the advantage of relatively high strength at high temperatures, e.g., for the range of about 649° C. to 760° C. while maintaining an advantageous combination of low coefficient of thermal expansion and good oxidation resistance. Ranges B and C are, respectively, preferred and more preferred ranges as contemplated by the present invention. Alloys within range B and, more particularly within Ranges A and C are generally characterized at room temperature by ultimate strengths in excess of about 900 MPa, yield strengths in excess of about 650 MPa, elongations in excess of about 10% and by reductions in area in excess of about 20% when tested in tensile. Alloys within the same ranges, when tested in tensile in air at 760° C. generally exhibit an ultimate tensile strength of at least 550 MPa, a yield strength of at least 500 MPa, an elongation of at least about 5% and a reduction in area of at least about 30%. Ranges D and E generally define alloys which do not embrittle upon exposure to temperatures in the vicinity of 600° C. and in which the second component of the alloy is formed by precipitation rather than as a primary product of casting. In addition, alloys containing chromium and/or molybdenum within Range E are more resistant to salt spray corrosion compared to other prior art chromium-free low expansion alloys.

PARTICULAR DESCRIPTION OF THE INVENTION

The alloys of the invention as described hereinbefore are advantageously made by melting alloying ingredients in a vacuum induction furnace, casting the alloys into ingot and hot working the ingot for example by extrusion and rolling, to provide hot formed bar stock. Compositions of such hot worked alloys of the invention are set forth, in percent by weight, in Table III, it being understood that the balance of the alloys is iron along with unavoidable impurities.

TABLE III

| Example No. | C | Mn | Si | Cu | Ni | Cr | Al | Ti | Co | Mo | Nb | B |
|---|---|---|---|---|---|---|---|---|---|---|---|---|
| 1 | .02 | .07 | .50 | .10 | 41.86 | .11 | 4.22 | 2.07 | 18.10 | .01 | 3.18 | .006 |
| 2 | .01 | .11 | .49 | .09 | 41.44 | .12 | 4.95 | 1.44 | 18.02 | .01 | 2.17 | .006 |
| 3 | .01 | .28 | .48 | .10 | 41.52 | .13 | 5.91 | 1.33 | 18.13 | .01 | 2.11 | .006 |
| 4 | .01 | .12 | .47 | .11 | 41.77 | .13 | 6.79 | 1.04 | 18.20 | .01 | 2.14 | .006 |
| 5 | .01 | .01 | .04 | .09 | 41.98 | .11 | 6.15 | 1.50 | 18.25 | .01 | 2.01 | .006 |
| 6 | .01 | .12 | .46 | .10 | 44.89 | .21 | 7.46 | 1.44 | 17.31 | .06 | 1.79 | .006 |
| 7 | .01 | .12 | .02 | .11 | 41.89 | .12 | 6.17 | 1.62 | 18.10 | 4.89 | .09 | .007 |
| 8 | .01 | .13 | .87 | .10 | 42.09 | .13 | 5.99 | 1.50 | 18.13 | .18 | .02 | .008 |
| 9 | .01 | .13 | .93 | .10 | 41.88 | .11 | 6.06 | 1.51 | 18.10 | 4.91 | .01 | .008 |
| 10 | .01 | .11 | .06 | .11 | 41.95 | .12 | 6.15 | 1.50 | 18.12 | 5.08 | 1.92 | .007 |
| 11 | .01 | .11 | .04 | .11 | 42.99 | .19 | 5.85 | 1.45 | 17.66 | .01 | 2.88 | .006 |
| 12 | .01 | .11 | .05 | .11 | 42.12 | .21 | 5.99 | 1.48 | 17.95 | .01 | 3.89 | .006 |
| 13 | .01 | .12 | .91 | .11 | 42.01 | .18 | 5.98 | 1.50 | 18.11 | 4.90 | 2.12 | .006 |
| 14 | .01 | .12 | .96 | .11 | 42.01 | .16 | 6.03 | 1.51 | 18.06 | .17 | 3.95 | .006 |
| 15 | .01 | .11 | .50 | .10 | 41.77 | .13 | 6.06 | 1.90 | 17.86 | 2.92 | 3.06 | .006 |
| 16 | .01 | .11 | .47 | .11 | 42.04 | .11 | 6.73 | 1.51 | 18.16 | .17 | 2.05 | .006 |
| 17 | .01 | .11 | .20 | .10 | 42.01 | .12 | 5.11 | 1.46 | 18.05 | .01 | 3.02 | .007 |
| 18 | .01 | .10 | .19 | .11 | 41.99 | .11 | 5.39 | 1.53 | 18.05 | .01 | 3.05 | .007 |
| 19 | .01 | .11 | .19 | .11 | 41.99 | .12 | 5.61 | 1.52 | 18.04 | .01 | 3.03 | .008 |
| 20 | .01 | .11 | .21 | .11 | 42.15 | .11 | 5.82 | 1.48 | 18.04 | .01 | 3.04 | .008 |
| 21 | .01 | .11 | .20 | .11 | 42.05 | .11 | 6.05 | 1.52 | 18.08 | .01 | 3.03 | .007 |
| 22 | .01 | .11 | .20 | .10 | 41.95 | .11 | 6.37 | 1.52 | 18.07 | .01 | 3.02 | .008 |

Although the specific alloys set forth in Table III have been cast and wrought, it is within the contemplation of the present invention to provide alloys within the compositional ranges set forth hereinbefore by any method known to the metallurgical art. For example, alloys of the present invention can be produced by casting and used in the cast form without any significant working. In addition, alloys of the present invention can be made in powder form and processed to desired shape by conventional pressing and sintering techniques, by spray casting, by flame or plasma spraying to form coatings or by any other technique known to powder metallurgy. The alloys of the present invention can also be produced by the technique of mechanical alloying as disclosed for example by Benjamin in U.S. Pat. No. 3,785,801 especially when it is desired to include therein an oxidic dispersoid phase such as one containing yttria. The powder product of mechanical alloying is then treated by techniques of powder metallurgy as previously discussed to provide articles of manufacture as desired.

After the alloys of the invention are produced by whatever means which are appropriate, they are advantageously heat treated by an annealing treatment in the range of about 980° C. to a temperature below the solidus of the particular alloy for up to about 12 hours usually followed by cooling. On cooling from annealing, a gamma prime phase is precipitated in the first component in ultra-fine discrete form and uniformly dispersed in the first component. Alloys of the invention as tested and reported herein have been given heat treatment at about 760° C. in order to eliminate a variable when comparative testing against alloys outside the present invention. Annealing, especially at temperatures above about 1038° C. can result in at least partial solutioning of the second component of the alloys. Heat treating of alloys, where some of the second component of the alloy has been solutioned carried out in the vicinity of about 870° C. may result in reprecipitating the second component in a form different from that produced upon casting and subsequent hot working.

Table IV contains data concerning properties of two age-hardened examples of alloys of the present invention as compared to properties of two age-hardened commercially available alloys.

TABLE IV

| Property | Example 20 | Example 10 | Alloy X | Alloy Y |
|---|---|---|---|---|
| Room Temperature Tensile | | | | |
| Y.S. (MPa) | 1110 | 986 | 896 | 1089 |
| U.T.S. (MPa) | 1475 | 1447 | 1275 | 1434 |
| El. % | 17 | 22 | 10 | 20 |
| R.A.% | 36 | 33 | 15 | 26 |
| 760° C. Tensile (in air) | | | | |
| Y.S. (MPa) | 772 | 655 | 517* | 800 |
| U.T.S. (MPa) | 807 | 772 | 620* | 855 |
| El. % | 41 | 38 | 35* | 5 |
| R.A.% | 85 | 82 | 75* | 10 |
| 649° C. Stress Rupture @ 510 MPa** (in air) | | | | |
| Life (Hours) | 170 | 135 | 90 | Notch Brittle |
| Elong. % | 37 | 45 | 10 | Notch Brittle |
| R.A. % | 52 | 57 | 12 | Notch Brittle |
| Grain Size (ASTM No.) | 8 | 8 | 3 | 4 |
| Average Grain Diameter (mm) | 0.022 | 0.022 | 0.125 | 0.091 |
| COE*** at 427° C. | 11.02 | 12.92 | 8.36 | 14.82 |
| Density (g/cc) | 7.72 | 7.78 | 8.28 | 8.22 |
| Modulus (GPa) | 172.4 | 172.4 | 158.6 | 200.0 |

Alloy X = INCOLOY TM alloy 909 nominally 38% Ni, 13% Co, 42% Fe, 4.7% Nb, 1.5% Ti, 0.4% Si, 0.03% Al, 0.01% C.
Alloy Y = INCONEL TM alloy 718 nominally 17–21% Cr, 50–55% Ni, 4.75–5.5% Nb, 2.8–3.3% Mo, 0.65–1.15% Ti, 0.2–0.8 Al, Bal. essentially Fe.
*Estimated
**Combination Notch ($K_T$ 3.6) and smooth bar
***Linear coefficient of thermal expansion at the temperature specified, ppm per °C.

In explanation of Table IV, the properties set forth therein were obtained on alloy specimens which were heat treated as follows:

Examples 10 and 20 were held at 1038° C. for two hours air cooled, held at 760° C. for 16 hours and then air cooled.

Alloy X was held at 1038° C. for one hour, air cooled, held at 774° C. for 8 hours, furnace cooled to 621° C., held for 8 hours and then air cooled.

Alloy Y was held at 1066° C. for 1 hour, air cooled, and held at 760° C. for 10 hours, furnace cooled to 621° C. and held for a total time, including time at 760° C. and furnace cooling time, of twenty hours.

Static oxidation mass gain was measured in mg/cm$^2$ as the result of a test which comprised heating alloys specimens in air at 704° C. for 504 hours. The test was conducted on Alloy X and on two alloys similar to Examples 10 and 20 but containing 2.5% and 4% aluminum respectively. Alloy X had a minimum mass gain of 7.1 mg/cm$^2$ and formed a heavy porous non-protective oxide which spalled extensively. All alloys of this invention had a tightly adhering thin non-spalling protective oxide, with a mass gain of less than 1.0 mg/cm$^2$. For good general oxidation resistance it is only necessary for the alloy to contain more than 2% Al, although greater than about 5% Al is necessary for dynamic oxygen embrittlement resistance.

The characteristics set forth in Table IV are for the various grain sizes as set forth therein. Corresponding characteristics on alloys having a uniform fine grain size of ASTM No. 8 (average grain diameter, 0.022 mm) are set forth in Table V.

TABLE V

| Property | Example 20 | Example 12 | Alloy X | Alloy Y |
|---|---|---|---|---|
| Room Temperature Tensile | | | | |
| Y.S. (MPa) | 1110 | 1185 | 1034 | 1206 |
| U.T.S. (MPa) | 1475 | 1544 | 1310 | 1379 |
| El. (%) | 17 | 18 | 15 | 20 |
| R.A. (%) | 36 | 32 | 37 | 39 |
| 760° C. Tensile (in Air) | | | | |
| Y.S. (MPa) | 772 | 710 | 517 | 793 |
| U.T.S. (MPa) | 807 | 848 | 620 | 827 |
| El. (%) | 41 | 43 | 30 | 33 |
| R.A. (%) | 85 | 83 | 85 | N.A. |
| 649° C. Rupture at 510 MPa (in air) | | | | |
| Life (Hrs) | 170 | 456 | 90 | 3000 |
| El. (%) | 37 | 23 | 10 | N.A. |
| R.A. (%) | 52 | 40 | 12 | N.A. |
| COE at 427° C. | 10.4 | 10.4 | 7.9 | 14.0 |
| Density g/cc | 7.72 | 7.77 | 8.27 | 8.21 |
| Modulus (GPa) | 172.4 | 172.4 | 158.6 | 200.0 |
| Oxid. MASS Gain (mg/cm$^2$) | 1.0 | 1.0 | 7.1 | 0.5 |

When tensile tested at 760° C., alloys of the present invention as set forth in Table II and heat treated as described for Examples 10 and 20, exhibit ultimate tensile strengths in the range of about 790 to 900 MPa, yield strengths in the range of 725 to 790 MPa, elongations up to 40% and reductions in area up to 88%. When similarly heat treated examples of the alloys of the present invention are tested in stress rupture at 649° C. and 510 MPa load, ives to rupture increase with increasing aluminum content from roughly 0.01 hour at 4% aluminum to 100–200 hours at 6% aluminum. At elevated temperatures, elongation and reduction in area are believed to increase in value simultaneously because of the reduction in dynamic oxygen embrittlement. Elongations and reductions in area also appear to increase in value as the aluminum content increases from about 5% to 6%. For the best combination of stress rupture properties, it is advantageous to maintain the aluminum content of alloys of the invention containing about 3% niobium and 1.3–2.0% titanium in the range of about 5% to 6% or 6.5%. Relatively little effect of aluminum content in the same alloys with the same heat treatment is observed in room temperature tensile testing. Room temperature strength gradually increases to a small extent with increased aluminum with a possible low anomaly at about 4.8% aluminum. The room temperature elongation and reduction in area versus aluminum content curves are essentially flat.

Figure 3:
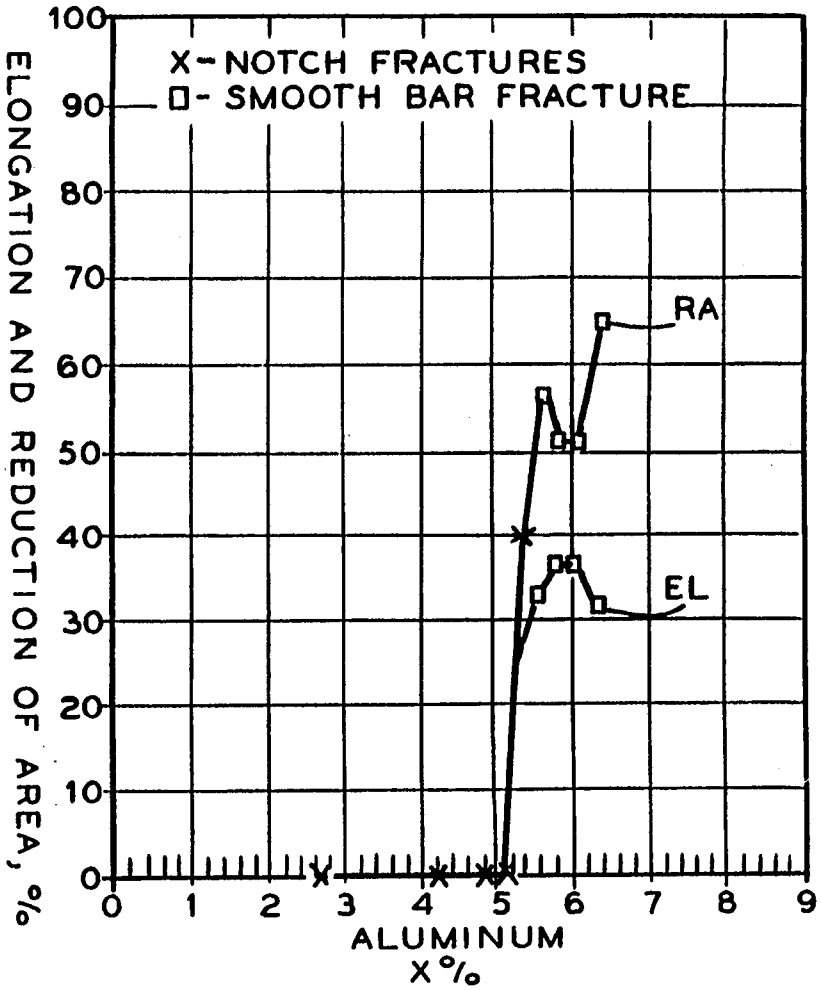
FIG. 3 is a graph interrelating elongation and reduction in area measured along with stress rupture lives as in FIG. 2 with aluminum content of alloys.
Figure 2:
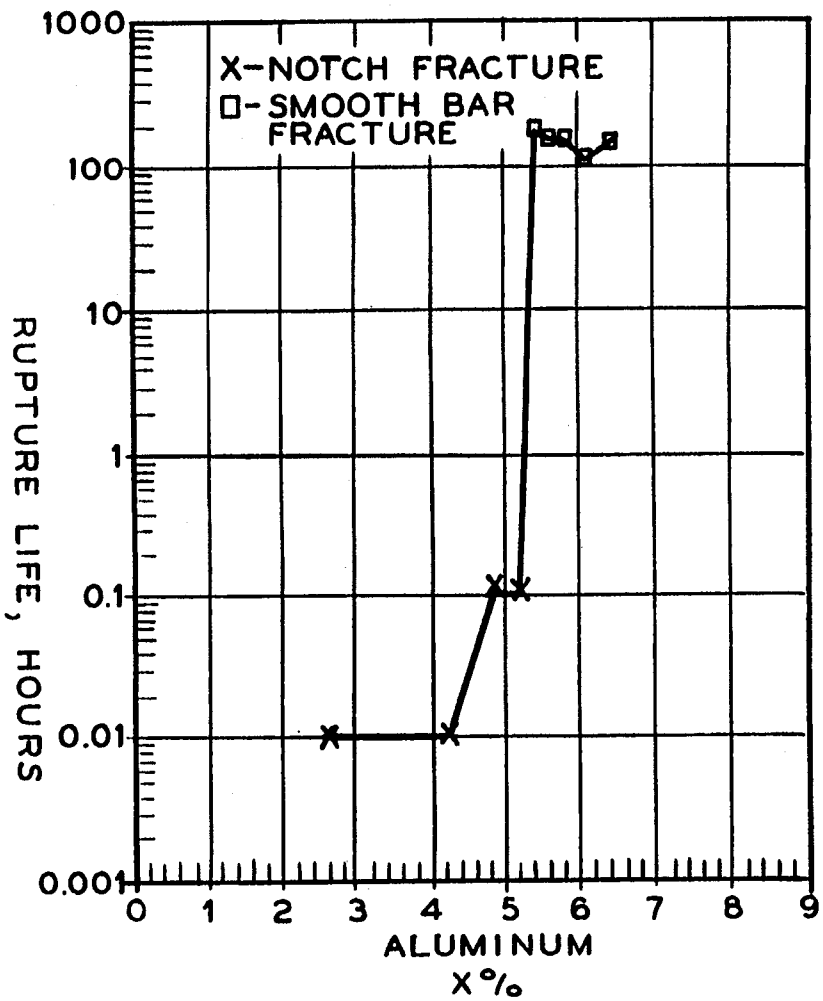
FIG. 2 is a graph interrelating stress rupture lives of alloys at 649° C. with aluminum content.

The advantages of the alloys of the present invention with respect to providing resistance to stress accelerated grain boundary oxidation at temperatures of 760° C. and 649° C. are dramatically illustrated in FIGS. 1 to 3 of the drawing. A series of nine alloys were made in a manner substantially identical to the manner of making the alloy examples set forth in Table III. These nine alloy compositions in percent by weight, balance being iron are set forth in Table VI.

TABLE VI

| Alloy No. | C | Mn | Si | Cu | Ni | Cr | Al | Ti | Co | Mo | Nb | B |
|---|---|---|---|---|---|---|---|---|---|---|---|---|
| A | 0.02 | 0.08 | 0.47 | .01 | 41.96 | 0.12 | 2.64 | 1.14 | 18.02 | 0.01 | 2.17 | 0.006 |
| Ex. 1 | 0.02 | 0.07 | 0.50 | 0.1 | 41.86 | 0.11 | 4.22 | 2.07 | 18.10 | 0.01 | 3.18 | 0.006 |
| Ex. 2 | 0.01 | 0.10 | 0.21 | 0.1 | 42.08 | 0.12 | 4.84 | 1.46 | 18.09 | 0.02 | 2.86 | 0.006 |
| Ex. 3 | 0.01 | 0.11 | 0.20 | 0.1 | 42.01 | 0.12 | 5.11 | 1.46 | 18.05 | 0.01 | 3.02 | 0.007 |
| Ex. 4 | 0.01 | 0.10 | 0.19 | 0.11 | 41.99 | 0.11 | 5.39 | 1.53 | 18.05 | 0.01 | 3.05 | 0.007 |
| Ex. 5 | 0.01 | 0.11 | 0.19 | 0.11 | 41.99 | 0.12 | 5.61 | 1.52 | 18.04 | 0.01 | 3.03 | 0.008 |
| Ex. 6 | 0.01 | 0.11 | 0.21 | 0.11 | 42.15 | 0.11 | 5.82 | 1.48 | 18.04 | 0.01 | 3.04 | 0.008 |
| Ex. 7 | 0.01 | 0.11 | 0.20 | 0.11 | 42.05 | 0.11 | 6.05 | 1.52 | 18.08 | 0.01 | 3.03 | 0.007 |
| Ex. 8 | 0.01 | 0.11 | 0.20 | 0.10 | 41.95 | 0.11 | 6.37 | 1.52 | 18.07 | 0.01 | 3.02 | 0.008 |

When tested (in the condition resulting from annealing and holding at 750° C. for 16 hours and air-cooled) in tensile at room temperature, all alloys in Table VI exhibited ultimate tensile strengths in the range of 1275 to 1655 MPa, 0.2% yield strengths in the range of 965 to 1138 MPa, elongations of about 30–40% and reductions in area of about 30–45%. There was some tendency for increase in strength and slight lowering ductility as measured by reduction in area with increasing aluminum. When tested in tensile at 760° C. however, the results plotted in FIG. 1 of the drawing were obtained. This Figure shows that, at test temperature, when the aluminum content of the alloys exceeds about 4%, elongation values and reduction in area values increase markedly even though the strength of the alloys remains essentially the same. FIGS. 2 and 3 of the drawing confirm the surprising phenomenon plotted in FIG. 1. FIG. 2 shows the life-to-rupture results of stress rupture tests in air at 649° C. using combination smooth bar-notched specimens ($K_T$3.6) of the alloys set forth in Table VI. Alloys containing below about 5% aluminum failed in the notch in 6 minutes or less whereas alloys containing more than about 5% aluminum exhibited smooth bar failures and had lives to rupture of about 100 hours or greater. The companion plot of FIG. 3 detailing the elongation and reduction in area of the stress rupture specimens clearly shows that, at 649° C., alloys of Table VI containing less than 5% aluminum are subject to stress accelerated grain boundary oxidation type failure whereas alloys containing more than 5% aluminum exhibit elongations in excess of 30% and reductions in area in excess of roughly 40%.

Plots of coefficient of thermal expansion at 427° C. and 593° C. versus aluminum content show only a modest rise as aluminum increases as discussed hereinbefore. In the range of 4% to 7.5% aluminum, the inflection temperature of alloys of the invention remains relatively constant between 371° C. and 385° C.

Alloys of the present invention which contain greater than about 5% aluminum exhibit a duplex or more complex structure which, at this writing is not fully understood. Optical microstructures of material with less than about 5% Al and annealed at 1038° C. followed by an isothermal treatment at 760° C. are similar to those of common nickel-based superalloys, and have a single component coarse grained matrix containing precipitated phase along with some grain boundary precipitates. However, material of the invention containing greater than about 5% Al with the same heat treatment has a duplex or more complex microstructure including a very fine, grain boundary precipitation. The appearance of the second component and increased grain boundary precipitation is significant in that it coincides with the material's resistance to oxygen embrittlement.

Figure 4:
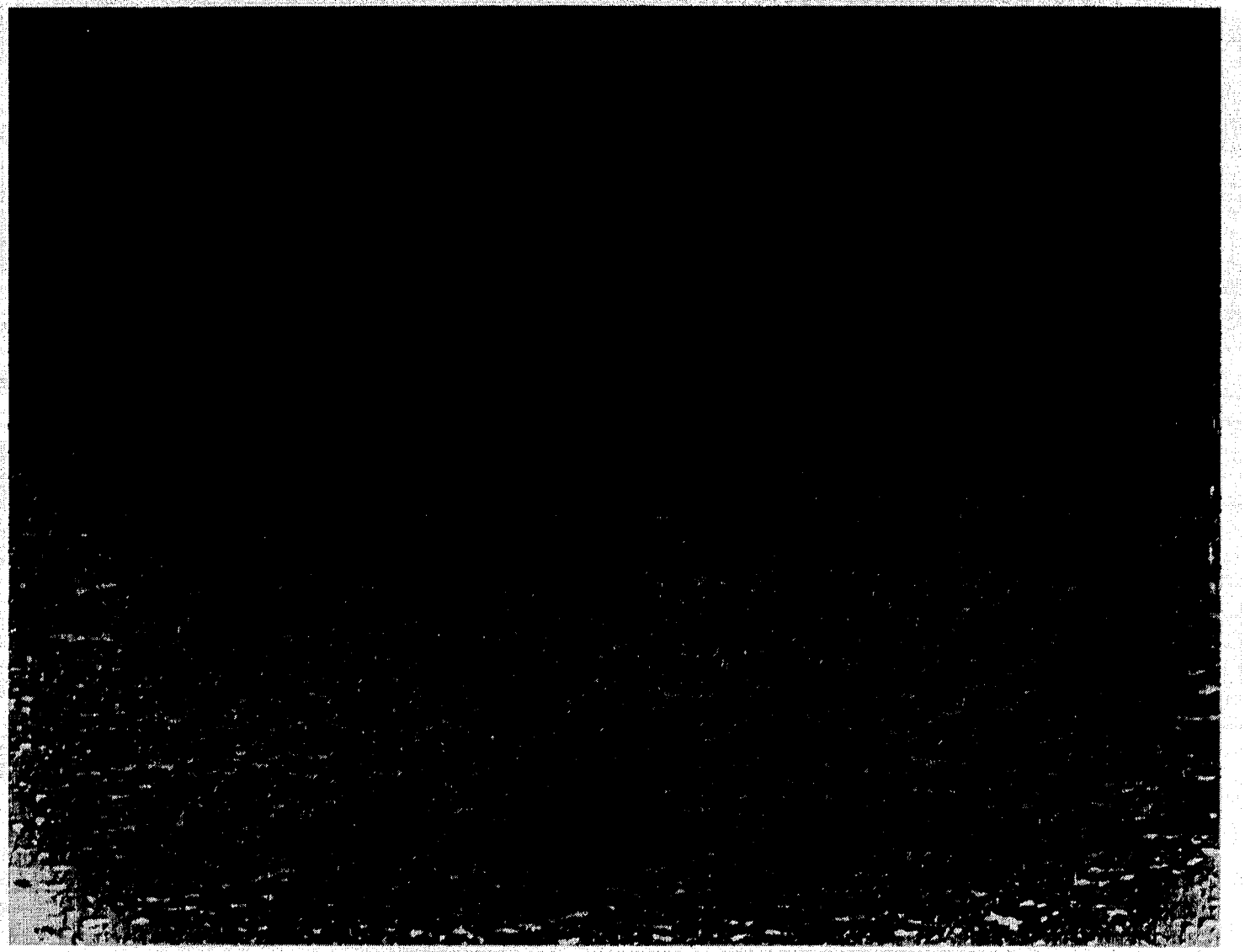
FIG. 4 is a reproduction of an optical micrograph showing the duplex structure of a typical alloy of the present invention.
Figure 5:
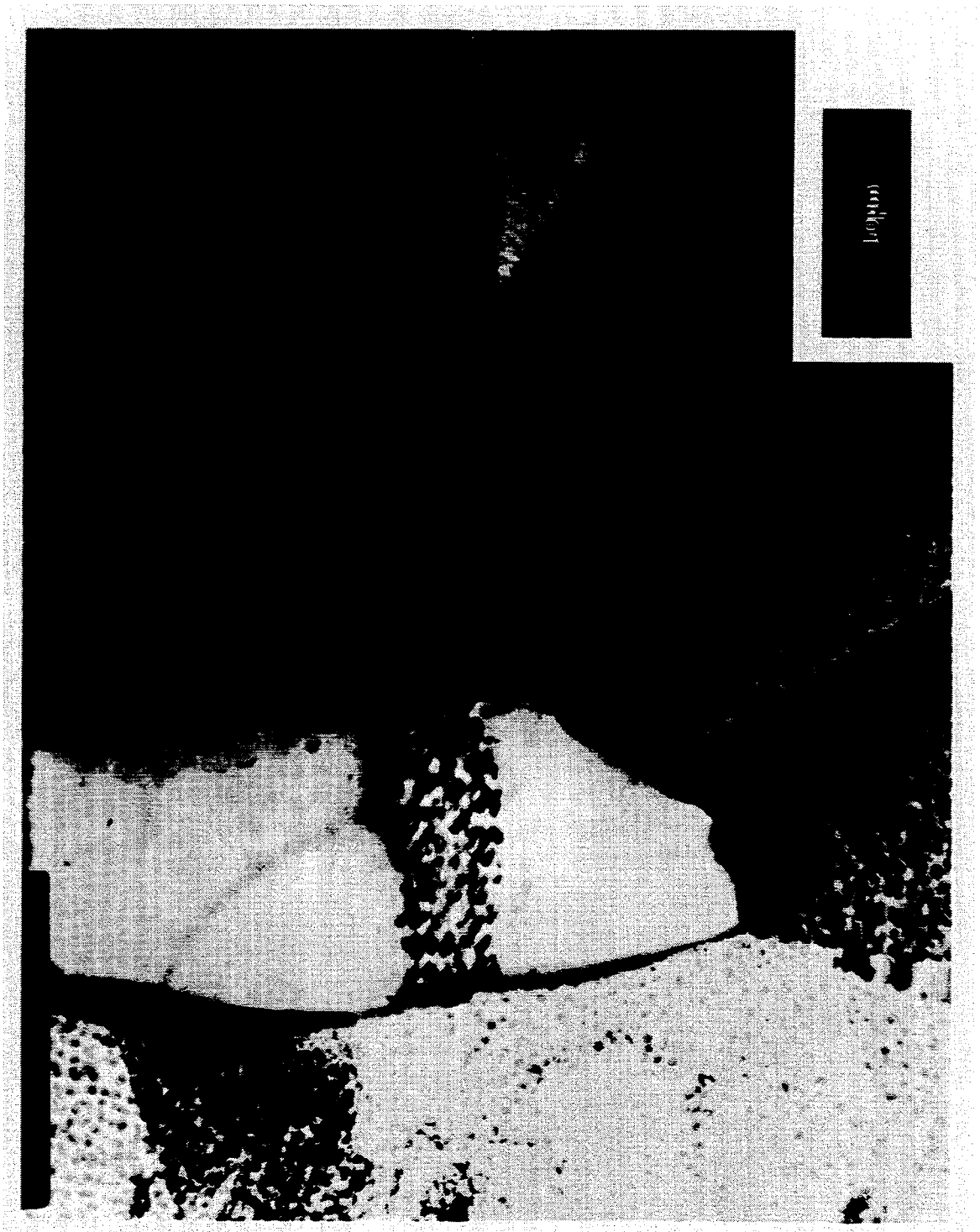
FIG. 5 is a reproduction of an electron micrograph showing the uniformity of precipitate in one component of an age-hardened duplex alloy of the present invention.

FIGS. 4 and 5 of the drawing show the structures of a typical alloy of the present invention. Preliminary X-ray diffraction analysis of alloy specimens containing greater than about 5% aluminum shows the first component is face centered cubic. FIG. 5 shows a phase assumed to be gamma prime ($Ni_3Al$) precipitated within the face centered cubic phase. Semi-quantitative scanning electron microscopy analysis of Example No. 3 has shown that the second component is significantly enriched in aluminum. This analysis has also shown that the second component is somewhat enriched in nickel and titanium and impoverished in iron and niobium compared to the bulk composition and the composition of the first component. An evaluation of published Ni-Fe-Al phase diagrams with some assumptions involving the role of Co and Ti suggests the second component should be a bcc phase. X-ray diffraction and electron diffraction examination suggests that the bcc phase has a B2 structure at room temperature. The presence of iron in the structure suggests that other types of ordering based on $Fe_3Al$ would be possible.

The microstructure is thus extremely complex. However, it is likely significant with respect to the development of oxygen embrittlement resistance. In addition, it is believed that the development of the second component in these alloys helps improve hot workability, and may indeed be necessary for hot workability of cast and wrought high-aluminum-containing nickel-cobalt-iron alloys.

An outstanding feature of the alloys of the invention is that they can be annealed at temperatures in the vicinity of 1038° C. for at least two hours without grain coarsening. Superficially similar alloys containing little or no aluminum, e.g., Alloy X grain coarsen significantly in as little time as one hour at 1038° C. as reported in Table IV. Thus alloys of the present invention can be used in brazed structures made with a high temperature brazing cycle and relatively inexpensive brazing alloys.

Alloys of the invention can contain in addition to the metallic and grain boundary phases described hereinbefore up to about 2% by weight of a microfinely dispersed oxidic phase comprising yttria, lanthana, ceria, alumina or, as is commonly produced by mechanically alloying and thermal processing, a yttria-alumina phase such as yttrium-aluminum garnet. Alloys of the invention may also include dispersoids such as Be, $B_4C$, BN, C, SiC, $Si_3N$, $TiB_2$, TiN, W, WC, $ZrB_2$ and ZrC. A specific example of an alloy composition which was produced by mechanical alloying consists of 42.58% nickel, 5.87% aluminum, 17.14% cobalt, 1.73% titanium, 2.78% niobium, 0.04% carbon, 0.37% yttrium as $Y_2O_3$ (per se or as oxide containing $Y_2O_3$) 0.61% oxygen balance essentially iron. After compacting, sintering, hot working, annealing and holding at 760° C., this alloy exhibited the mechanical characteristics set forth in Table VII based upon tests of combined smooth and notched bars.

TABLE VII

| |
|---|
| 649° C. Stress Rupture |
| @ 510 MPa (in air) |
| Life (Hours) 859.5 |
| Failure in Notch |
| 760° C. Stress Rupture |
| @ 241 MPa (in air) |
| Life (Hours) 307.4 |
| Failure in Notch |

Figure 6A:
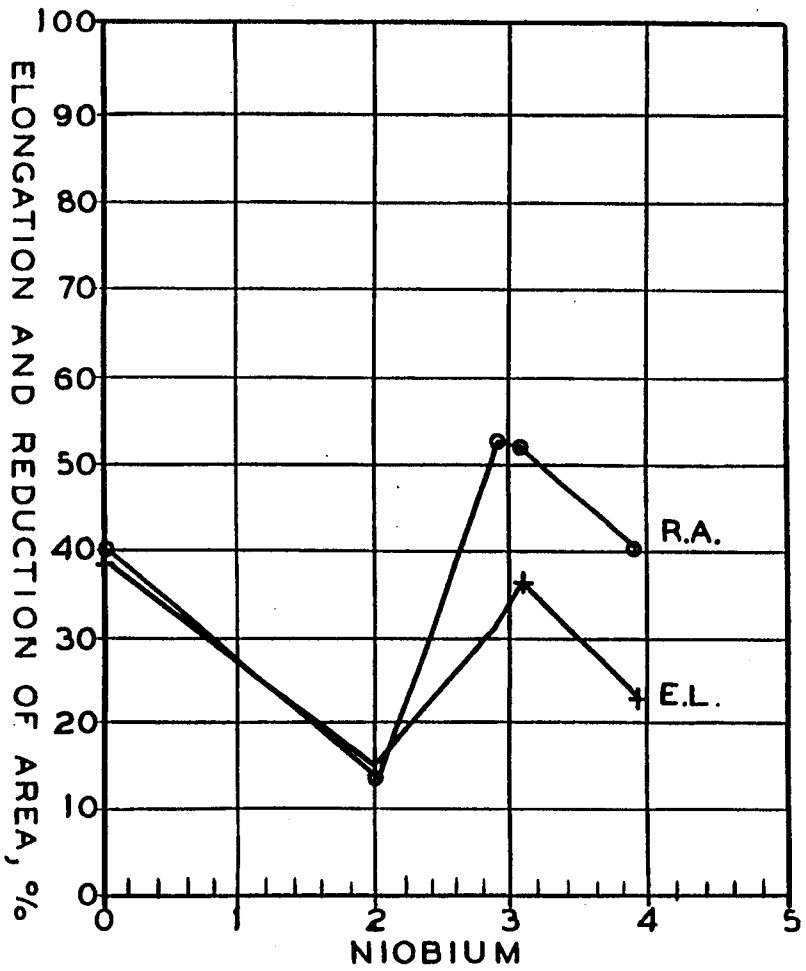
FIGS. 6 and 6A are graphs depicting the effect of niobium content on stress rupture life elongation and reduction in area of alloys of the invention at 649° C. tested on combination smooth-notched bars ($K_T$3.6).
Figure 6:
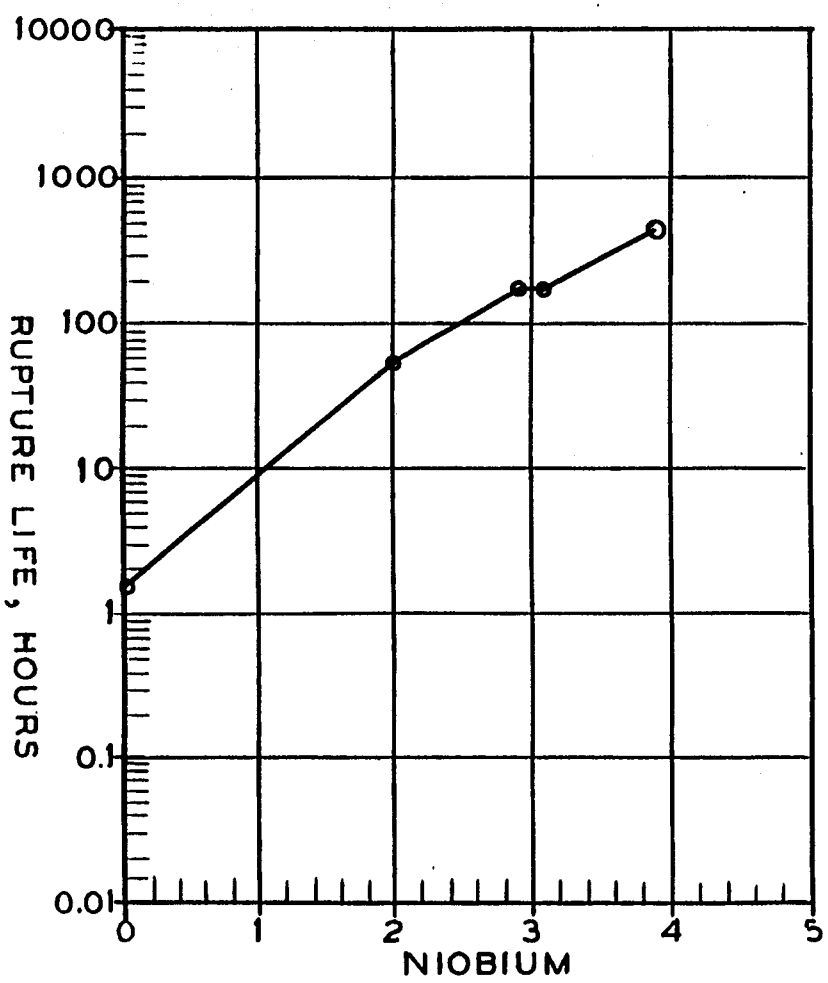

The niobium content of the alloys of the present invention can be of substantial significance. The niobium content of alloys of the present invention is most advantageously in the range of 2.5 to 4% by weight and, if relatively low ductility at 649° C. can be tolerated, the niobium content can be in the range of 1.5 to 4% or even 6% depending upon titanium content. FIGS. 6 and 6A are based upon a series of alloys inclusive of Examples 12 and 20 as set forth in Table III. FIG. 6 shows that in stress rupture in air under a load of 510 MPa at 649° C. samples of alloys of the invention containing 2.5% or more of niobium lasted for at least about 100 hours while at the same time exhibited at least about 23% Elongation and 40% reduction in area. Ductility in terms of elongation and reduction in area appears to be maximized at about 3% (Example 20) with life to rupture being well over 100 hours. Those skilled in the art will appreciate that although in FIG. 6, increase in life to rupture with increasing niobium appears to be essentially linear, the rupture life scale is logarithmic with the life-to-rupture at 3% niobium being roughly two orders of magnitude greater than the life-to-rupture exhibited by a niobium-free alloy.

Alloys of the invention which contain high amounts of aluminum, e.g. greater than about 6% and which are made by conventional melting and casting contain the second component in the as-cast form in such an amount and configuration that the second component cannot be solubilized in the solid matrix by heat treatment. Worked structures produced from alloys of the invention containing such high amounts of aluminum often exhibit anisotropic mechanical properties owing to the difference in hot working characteristics between the matrix and the second component. In situations where existence of anisotropic mechanical characteristics are undesirable in worked alloy structures, it is advantageous to maintain the aluminum content of the alloys of the invention below about 6%, e.g. in the range of about 4.3 to about 6% most advantageously in the range of 4.8 to 5.8%. A number of alloy examples having aluminum contents in the range of 5.0 to 6.2% are set forth in Table VIII. Each of the alloys of Table VIII was made in the same manner as described for the Examples of Table III.

TABLE VIII

| Example No. | C | Fe | Ni | Cr | Al | Ti | Nb | Co | B | Mo |
|---|---|---|---|---|---|---|---|---|---|---|
| 23 | .012 | 24.80 | 34.14 | .101 | 5.40 | 1.40 | 3.00 | 31.25 | .0082 | — |
| 24 | .011 | 29.73 | 34.19 | .106 | 5.44 | 1.39 | 2.99 | 26.26 | .0054 | — |
| 25 | .013 | 34.52 | 34.13 | .117 | 5.37 | 1.40 | 3.02 | 21.30 | .0070 | — |
| 26 | .0086 | 30.14 | 36.88 | .113 | 5.42 | 1.38 | 3.01 | 23.04 | .0027 | — |
| 27 | .012 | 25.06 | 39.69 | .109 | 5.45 | 1.41 | 2.99 | 24.94 | .0073 | — |
| 28 | .0098 | 29.73 | 40.10 | .111 | 5.42 | 1.39 | 2.99 | 20.34 | .0085 | — |
| 29 | .011 | 34.63 | 40.02 | .103 | 5.50 | 1.41 | 2.99 | 15.35 | .0079 | — |
| 30 | .022 | 29.63 | 34.10 | .113 | 5.38 | .84 | 1.54 | 28.33 | .0076 | — |
| 31 | .011 | 29.78 | 34.11 | .113 | 5.37 | .22 | 1.54 | 28.91 | .0082 | — |
| 32 | .0095 | 29.65 | 34.08 | .130 | 5.34 | 1.37 | .081 | 29.19 | .0082 | — |
| 33 | .015 | 29.72 | 34.04 | .139 | 5.36 | .87 | .026 | 29.71 | .0086 | — |
| 34 | .0059 | 29.64 | 34.09 | .123 | 5.28 | .23 | .031 | 30.57 | .0091 | — |
| 35 | .0073 | 30.09 | 34.03 | .107 | 5.39 | 1.40 | 2.93 | 26.12 | .0085 | — |
| 36 | .010 | 30.05 | 33.86 | .110 | 5.38 | .84 | 2.99 | 26.78 | .0087 | — |
| 37 | .010 | 29.36 | 34.31 | .153 | 5.26 | .26 | 3.00 | 27.75 | .0083 | — |
| 38 | .0070 | 29.99 | 33.99 | .112 | 5.40 | 1.39 | 1.56 | 27.65 | .0081 | — |
| 39 | .011 | 29.30 | 35.53 | .0062 | 6.12 | 1.48 | 2.94 | 24.57 | .0079 | .003 |
| 40 | .011 | 26.84 | 35.19 | .0044 | 6.14 | 1.52 | 2.94 | 25.07 | .0076 | 2.01 |
| 41 | .0098 | 24.61 | 35.24 | .0082 | 6.14 | 1.49 | 2.95 | 25.16 | .0067 | 4.02 |
| 42 | .011 | 26.79 | 35.21 | 1.90 | 6.11 | 1.56 | 2.96 | 25.06 | .0077 | 0.24 |
| 43 | .012 | 25.13 | 35.09 | 2.01 | 6.11 | 1.53 | 2.94 | 25.02 | .0070 | 1.92 |
| 44 | .010 | 22.86 | 35.17 | 2.01 | 6.11 | 1.49 | 2.93 | 25.08 | .0081 | 4.03 |
| 45 | .0099 | 24.86 | 35.24 | 4.10 | 6.11 | 1.52 | 2.93 | 25.02 | .0077 | 0.15 |
| 46 | .013 | 22.93 | 35.17 | 4.19 | 6.04 | 1.49 | 2.92 | 25.13 | .0070 | 1.92 |
| 47 | .014 | 20.95 | 35.08 | 4.15 | 6.15 | 1.52 | 2.92 | 25.04 | .0084 | 3.92 |

NOTE:
All of Examples 23 to 47 contained manganese in the range of 0.01 to 0.1%, silicon in the range of 0.10 to 0.13% and copper in the range of 0.10 to 0.15%. Sulfur reported only for Examples 23 to 29 was below 0.006%.

The alloy examples of Table VIII were tested in various manners. For instance, Examples 23 to 29 were tested to show the effects of annealing and aging treatments and exposure at 593° C. for 100 hours at room temperature. It was found that with an aging treatment of 8 hours at 718° C. furnace cooled, held for 8 hours at 621° C. followed by air cooling best results were obtained with Examples 23 and 27 which contain about 25% iron and 25% or more cobalt. Example 23 gave useful room temperature tensile results when annealed prior to aging for one hour in the range of 982° to 1093° C. Example 29 exhibited useful room temperature mechanical properties after aging and 593° C. 100 hour exposure only when annealed for one hour in the narrower range of 1038° to 1093° C. Table IX sets forth the room temperature tensile data obtained with Examples 23 and 27.

TABLE IX

| Example No. | Anneal (°C.) | As Annealed and Aged Y.S. (MPa) | U.T.S. (MPa) | El. (%) | R.A. (%) | As Annealed, Aged and Exposed at 593° C. Y.S (MPa) | U.T.S. (MPa) | El. (%) | R.A. (%) |
|---|---|---|---|---|---|---|---|---|---|
| 23 | 982 | 1192 | 1544 | 14 | 27 | 1213 | 1586 | 10 | 10 |
| | 1038 | 1165 | 1524 | 17 | 30 | 1158 | 1517 | 9 | 14 |
| | 1093 | 1103 | 1455 | 19 | 38 | 1165 | 1441 | 6 | 8 |
| 27 | 982 | 1227 | 1806 | 13 | 14 | —* | —* | —* | —* |
| | 1038 | 1193 | 1551 | 17 | 39 | 1296 | 1620 | 11 | 8 |
| | 1093 | —* | —* | —* | —* | 1193 | 1586 | 11 | 12 |

*Lack of data indicates lack of room temperature ductility in that under the conditions of heat treatment and exposure, if any, the tensile specimen broke in the threads.

In general, of Examples 23 to 29, alloys containing greater than about 30% cobalt showed lack of room temperature ductility after 593° C. exposure under the processing and testing conditions specified. It has been found that when iron is in excess of about 30%, stability to exposure at or about 593° C. can be achieved by reducing or removing titanium without changing the cobalt content of the alloy.

Contrary to room temperature behavior, when annealed at 1038° C. and aged either at 760° C. for 16 hours or at 718° C. for 8 hours and 621° C. for 8 hours (two step age) or 899° C. for 4 hours followed by 718° C. for 8 hours and 621° C. for 8 hours, alloys 23 to 29 gave useful mechanical characteristics in tensile at 649° C. For example, alloy 25 aged at 760° C. exhibited a yield strength of 924 MPa, an ultimate tensile strength of 1165 MPa and elongation of 24% and a reduction in area of 50%.

Examples 30 to 38 were prepared to study the effects of niobium and titanium on stability as reflected by room temperature tensile ductility after annealing, aging and exposure at 593° C. This study resulted in the finding that the presence of niobium is important in maintaining room temperature ductility after 100 hours exposure at 593° C. and that the presence of titanium is deleterious. Table X sets forth data in this regard.

TABLE X

| Example No. | Nominal % Nb | Nominal % Ti | Room Temperature Tensile Ductility: As Aged El. % | As Aged R.A. % | After 593° C., 100 Hour Exposure El. % | After 593° C., 100 Hour Exposure R.A. % |
|---|---|---|---|---|---|---|
| 34 | 0 | 0.2 | 32 | 46 | 5 | 3 |
| 31 | 1.5 | 0.2 | 25 | 49 | 19 | 43 |
| 37 | 3 | 0.2 | 24 | 48 | 25 | 47 |
| 33 | 0 | 0.8 | 26 | 42 | 2 | 5 |
| 30 | 1.5 | 0.8 | 23 | 42 | 18 | 35 |
| 36 | 3.0 | 0.8 | 19 | 37 | 11 | 15 |
| 35 | 0 | 1.4 | 23 | 41 | 2 | 4 |
| 38 | 1.5 | 1.4 | 20 | 40 | 12 | 15 |
| 32 | 3 | 1.4 | 25 | 40 | 1 | 3 |

The data in Table X show that in each alloy containing about 30% iron and devoid of niobium, there is a severe reduction in room temperature tensile elongation and reduction in area after exposure at 593° C. In addition, there is a trend in the data presented in Table X which indicates that even in the presence of niobium, room temperature tensile ductility after exposure at 593° C. decreases with increasing titanium such that, for alloys of the present invention containing greater than 30% iron which may be exposed to temperatures in the vicinity of 593° C., the titanium content should be limited to about 0.5% maximum. Additional tests on Examples 30–38 at 649° C. showed an increase in strength with increases in niobium and titanium individually and in combination. Likewise both titanium and niobium individually and in combination tend to lower the thermal. expansion coefficient of the alloys. In alloys of the invention containing about 25% or less iron, although titanium reduces room temperature ductility after exposure to 593° C., these alloys still remain ductile. In contrast, alloys containing about 30% iron and titanium greater than about 0.5% do not retain useful room temperature ductility after exposure to 593° C.

Examples 39 to 47 were prepared to study the effects of chromium and molybdenum in alloys of the invention. These alloys were tested in salt spray (Fog) for 720 hours according to the ASTM test procedure B117-85 using samples annealed at 1038° C. for one hour, air cooled and aged at 760° C. for 16 hours and air cooled. The base zero chromium-molybdenum alloy of Example 39 showed a corrosion rate of about 12 micrometers per year with a maximum depth of pit of about 165 micrometers. With increasing chromium and/or molybdenum up to a total of 8% the corrosion rate decreased to 0.76 micrometers/year and maximum pit depth to less than 25 micrometers. Tensile specimens of the alloys of Examples 39 to 47 annealed for two hours at 1038° C. and aged for 16 hours at 760° C. exhibited good results at 649° C. roughly in the vicinity of 930 MPa yield strength, 1158 ultimate tensile strength, 20% elongation and 30% reduction in area. At room temperature, tensile results at higher molybdenum levels tended to be slightly low in elongation and reduction in area, a tendency also noted at 649° C. although less severe at the elevated temperature. Use of combination notch ($K_T$3.6) smooth rupture bars at 649° C. under a load of 510 MPa gave life to rupture results increasing from about 100 to 500 hours with elongations of about 30% and reductions in area averaging 39% in molybdenum-free alloys as chromium increased from 0 to 4% replacing iron. At any given chromium level, addition of molybdenum decreased life to rupture. More or less the same pattern of increase with increase in chromium and decrease with increase in molybdenum was exhibited in Charpy V-Notch impact tests at room temperature. Determination of coefficients of thermal expansion in Examples 39 to 47 showed increases in this characteristic with increases in either or both chromium and molybdenum. Nevertheless, coefficients of thermal expansion were at least 10% less than coefficients of expansion of conventional superalloys such as INCONEL alloy 718.

In addition to the foregoing examples of the invention, a series of alloy compositions were made containing 5.9 to 6.2% aluminum, about 1.5% titanium, about 3% niobium, less than 0.01% boron 20 to 34%, iron 18 to 40%, cobalt and the balance nickel. The alloys were melted, cast, worked and heat treated by holding for 2 hours at 1038° C., air cooling and holding at 760° C. for 16 hours. When stress rupture data obtained with combination smooth-notch bars under a load of 510 MPa at 649° C. is associated with alloy compositions represented by points on an iron-versus-cobalt plot, it is apparent that alloy compositions containing less than about 24% iron and 25 or 26% cobalt exhibit notch failure and appear to be embrittled by stress accelerated grain boundary oxidation. Maximum life-to-rupture appears with compositions plotted in the area of about 15 to 24% iron and 35 to 40% or more cobalt. Life to rupture under the test conditions falls to zero with compositions containing more than 30% iron and 34% or so cobalt although ductility of these alloys is higher. Ductility as measured by percent reduction in area appears adequate or good with alloys having any percent cobalt within the range tested provided that the compositions contain greater than about 25% iron. With compositions containing less than 25% iron adequate or good ductility occurs only with compositions containing more than 25 or 28% cobalt. Of the alloy compositions tested, the best stress rupture life (438 hours) with 31% reduction in area was exhibited by an alloy containing 39.78% cobalt and 18.93% iron, but CTE was increased due to cobalt substitution for iron. The worst rupture results in this series of tests were zero hours life with nil ductility exhibited by compositions containing 17.88% cobalt and 24.6% iron, 23.04% cobalt and 24.06% iron and 27.45% cobalt and 20.38% iron. Those skilled in the art will appreciate that the dividing lines between good and bad alloy compositions based upon 510 MPa, 649° C. stress rupture test results are approximate and will shift somewhat with variations in alloy composition, processing, heat treatment, grain size, as well as test conditions (including applied stress, test temperature, notch acuity, and specimen configuration), and other parameters. For example, given an alloy containing 30% iron, increased iron content lowers CTE, and decreased iron content appears to increase alloy stability and rupture strength and appears to reduce beta formation which provides stress accelerated grain boundary embrittlement protection.

While the present invention has been described and illustrated with respect to specific alloys, those skilled in the art will appreciate that this description and illustration is not limiting with respect to the appended claims. The alloys of the invention can be employed in any form and for any usage in which high strength and ductility at both room temperature and elevated temperatures are criteria along with resistance to stress accelerated grain boundary oxidation. Such usages include components and parts for turbines operating at high temperatures, critical structural components such as seals, rings, discs, compressor blades, and casings, and rocket components such as hydrogen turbine pump parts and power heads. The alloy can also be used as matrix material for metal matrix composites or fiber composites, a high strength ferro-magnetic alloy, gun barrels, high strength fasteners, superconductor sheathing and in general where good wear and cavitation and erosion resistance is needed.

Although the examples of the alloys of the present invention as described in this specification were all cast and worked, it is within the contemplation of the invention to produce and use the alloys in the cast form, in the form of powder and in any other form and manner conventional in the metallurgical art.

The embodiments of the invention in which an exclusive property or privilege is claimed are defined as follows:

1. An oxidation resistant alloy having a relatively low coefficient of thermal expansion of less than about $13\times10^{-6}$ per ° C. at 427° C., characterized by resistance to oxygen embrittlement and further characterized by notch ductility at about 650° C. in the annealed and aged condition consisting essentially of, in percent by weight, about 25 to 50% nickel, about 5 to 50% cobalt, about 45 to 75% nickel plus cobalt, about 4 to 10% aluminum, about 0 to 2% titanium, 0 to about 0.2% carbon, 0 to about 6% chromium, 0 to about 2% total manganese, silicon and copper, 0 to about 0.5% silicon, 0 to about 5% molybdenum plus tungsten, about 0 to about 6% niobium, 0 to about 0.1% zirconium, 0 to about 0.02% boron, balance essentially iron in the range of 20% to 50% along with incidental impurities.

2. An alloy as in claim 1 which contains at least about 2% niobium.

3. An alloy as in claim 1 wherein the nickel content is about 30% to 45%.

4. An alloy as in claim 2 wherein the aluminum content is about 4.8 to 6%.

5. An oxidation resistant alloy consisting essentially of, in weight percent, about 25 to 50% nickel, about 5 to 50% cobalt, about 45 to 75% nickel plus cobalt, about 4 to 10% aluminum, 0 to 3% titanium, 0 to 10% niobium, 0 to 10% tantalum, 0 to 10% molybdenum, 0 to 10% tungsten, 0 to 3% vanadium, 0 to 2% silicon, 0 to 1% manganese, 0 to 1% copper, 0 to 6% chromium, 0 to 2% hafnium, 0 to 2% rhenium, 0 to 0.3% boron, 0 to 0.3% zirconium, 0 to 0.1% total magnesium, calcium, yttrium and rare earths, 0 to 0.5% nitrogen, 0 to 0.3% carbon, the balance of the alloy being iron in the range of 20 to 50% and incidental impurities, said alloy having a duplex structure, one crystalline component of which is a gamma phase, having a gamma prime precipitate therein, and another component have a bcc B2 structure enriched in aluminum compared to said crystalline component and said alloy having a coefficient of thermal expansion of less than about $13\times10^{-4}$ per ° C. at 427° C.

6. An oxidation resistant alloy as in claim 5 wherein cobalt is at least about 24% when iron is less than about 24%.

7. An oxidation resistant alloy as in claim 5 containing at least 1% niobium.

8. An oxidation resistant alloy as in claim 5 containing at least about 2.5% niobium and less than about 0.8% titanium.

9. An oxidation resistant alloy as in claim 5 containing about 4.8 to 6% aluminum.

10. An oxidation resistant alloy as in claim 5 containing about 1 to 2.5 % titanium and less than about 30% iron.

11. An oxidation resistant alloy as in claim 6 containing 0 to about 5% total molybdenum plus tungsten.

12. An oxidation resistant alloy as in claim 5 containing about 25 to 40% cobalt.

13. An oxidation resistant alloy as in claim 12 containing about 20 to 27.5% iron.

14. An oxidation resistant alloy as in claim 5 containing 0 to about 2% vanadium.

15. An oxidation resistant alloy as in claim 5 containing about 2 to 6% chromium.

16. An oxidation resistant alloy as in claim 5 containing about 2 to 6% molybdenum.

17. An oxidation resistant alloy as in claim 5 containing about 4 to 10% chromium plus molybdenum.

18. An oxidation resistant alloy as in claim 5 containing 0 to about 0.3% nitrogen.

19. An oxidation resistant alloy as in claim 5 containing about 25 to 45% nickel, about 25 to 35% cobalt, about 20 to 27.5% iron, about 4.8 to 5.8% aluminum, about 0 to 1.8% titanium, 0 to about 0.1% carbon, 0 to about 0.3% silicon, about 0.5 to 4% niobium, the sum of copper plus manganese being 0 to about 0.5% and the sum of molybdenum plus tungsten being 0 to about 5%.

20. An oxidation resistant alloy as in claim 5 containing about 25 to 40% nickel, about 25 to 35% cobalt, about 27.5 to 35% iron, about 4.8 to 5.8% aluminum, about 0 to 0.8% titanium, 0 to about 0.5 manganese, 0 to about 0.75% silicon, 0 to about 2% molybdenum, 0 to about 2% niobium and 0.001 to 0.01% boron.

21. An oxidation resistant alloy as in claim 5 which contains as said dispersoid an oxidic phase.

22. An oxidation resistant alloy as in claim 21 which contains about 0.2 to 2% oxidic phase selected from the group consisting of yttria and complex oxide of yttria.

23. The alloy of claim 5 wheien said alloy contains at least one additive selected from the group consisting of deoxidants, grain refiners and dispersoids.

24. An alloy consisting essentially of, in weight percent, about 20 to 50% nickel, about 5 to 50% cobalt, about 45 to 75% nickel plus cobalt, about 4 to 6% aluminum, about 0.5 to 6% niobium, about 0 to 0.5% titanium, about 0 to 0.1% carbon, about 0 to 2% silicon, about 0 to 0.3% boron, about 0 to 10% molybdenum, about 0 to 10% tungsten, about 0 to 10% tantalum, about 0to 3% vanadium, about 0 to 1% copper, about 0 to 1% manganese, about 0 to 6% chromium, about 0 to 2% rhenium, about 0 to 2% hafnium, about 0 to 0.3% zirconium, 0 to 0.1% total magnesium, calcium, yttrium and rare earths, about 0 to 0.5% nitrogen and balance iron in the range of about 20 to 50% along with incidental impurities and said alloy having a coefficient of thermal expansion of less than about $13\times10^{-6}$ per ° C. at 427° C.

25. The alloy of claim 24 wherein the iron content is less that about 30%.

26. The alloy of claim 25 wherein the bobalt content is about 25 to 40%.

27. The alloy of claim 24 wherein the chromium content is about 2 to 6%.

28. The alloy of claim 24 wherein the aluminum content is about 4.8 to 6%.

* * * * *